US006478395B2

(12) United States Patent
Tanaka et al.

(10) Patent No.: US 6,478,395 B2
(45) Date of Patent: Nov. 12, 2002

(54) LIQUID JETTING APPARATUS

(75) Inventors: Ryoichi Tanaka; Tomoaki Takahashi, both of Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/725,869

(22) Filed: Nov. 30, 2000

(65) Prior Publication Data

US 2001/0002836 A1 Jun. 7, 2001

(30) Foreign Application Priority Data

Dec. 1, 1999 (JP) ..... 11-342036

(51) Int. Cl.[7] ..... B41J 2/045
(52) U.S. Cl. ..... 347/11
(58) Field of Search ..... 347/9, 10, 11, 347/15, 68, 69, 70, 71, 72

(56) References Cited

U.S. PATENT DOCUMENTS 6,328,397 B1 * 12/2001 Shimizu et al. ..... 374/10
6,382,753 B1 * 5/2002 Teramae et al. ..... 347/10

FOREIGN PATENT DOCUMENTS

| | | | | |
|---|---|---|---|---|
| EP | 737 586 A1 | * | 10/1996 | ..... B41J/2/21 |
| EP | 0 738 602 | | 10/1996 | ..... B41J/2/45 |
| EP | 0 788 882 | | 8/1997 | ..... B41J/2/04 |
| EP | 0 841 164 | | 5/1998 | ..... B41J/2/45 |
| EP | 816 081 | * | 7/1998 | ..... B41J/2/45 |
| EP | 1 023 997 | | 8/2000 | ..... B41J/2/01 |
| JP | 9-52360 | | 2/1997 | |
| JP | 9-226106 | | 9/1997 | |
| JP | 10-16211 | | 1/1998 | |
| JP | 10-24570 | | 1/1998 | ..... B41J/2/045 |
| JP | 11-20165 | | 1/1999 | |

OTHER PUBLICATIONS

European Search Report dated Mar. 19, 2001.
JPO Abstract 10(1998)–24570, Jan. 27, 1998.

* cited by examiner

*Primary Examiner*—Thinh Nguyen
*Assistant Examiner*—Blaise Mouttet
(74) *Attorney, Agent, or Firm*—Sughrue Mion, PLLC

(57) ABSTRACT

A liquid jetting apparatus of the invention includes a pressure chamber having an inside space whose volume is changeable, into which a liquid is supplied and which is communicated with a nozzle. A Helmholtz resonance frequency of the pressure chamber has a period of TH. A signal-generating unit generates a driving signal, which includes a first signal-element for causing the pressure chamber to expand, a second signal-element for causing the pressure chamber to contract from an expanded state thereof in order to jet a drop of the liquid through the nozzle, and and a third signal-element for causing the pressure chamber to expand to an original state before outputting the first signal-element after the drop of the liquid is jetted. A pressure-generating unit causes the pressure chamber to expand and contract, based on the driving signal. An interval between a starting time of outputting the first signal-element and a starting time of outputting the second signal-element and an interval between a starting time of outputting the second signal-element and a starting time of outputting the third signal-element are set substantially equal to the period TH of the Helmholtz resonance frequency. A sum of an amplitude of the first signal-element and an amplitude of the third signal-element is set substantially equal to an amplitude of the second signal-element.

28 Claims, 7 Drawing Sheets

LIQUID JETTING APPARATUS

FIELD OF THE INVENTION

This invention relates to a liquid jetting apparatus wherein for example a longitudinal-mode piezoelectric vibrating member is used as an actuator.

BACKGROUND OF THE INVENTION

A head member of a liquid jetting apparatus, such as a recording head of an ink-jetting recording apparatus, has a pressure-generating chamber (pressure chamber) which is communicated with a nozzle and which is partly formed by an elastic plate. A movable end of a piezoelectric vibrating member is joined to the elastic plate. The piezoelectric vibrating member can expand and contract. Thus, a volume of the pressure chamber can be changed by causing the piezoelectric vibrating member to expand and contract. As a result, ink can be supplied into the pressure chamber and a drop of the ink can be jetted from the pressure chamber.

As an actuator for driving such a recording head at a high speed, a longitudinal-mode piezoelectric vibrating member is used, which consists of alternatively stacked piezoelectric material and electric conductive layer and which can extend in a longitudinal direction thereof.

The longitudinal-mode piezoelectric vibrating member needs a smaller area in order to join to the pressure chamber than a bending-type piezoelectric vibrating member does. In addition, the longitudinal-mode piezoelectric vibrating member can be driven at a higher speed. Thus, a printing operation can be achieved with a finer resolution (definition) and at a higher speed.

However, although such a longitudinal-mode piezoelectric vibrating member can be driven at a higher speed, a reducing rate (damping rate) of remaining vibration (residual vibration) thereof is smaller. Thus, larger remaining vibration may be remained after a drop of the ink has been jetted, which may affect behavior of a meniscus of the ink. For example, if a position of the meniscus remains disordered when a next drop of the ink is jetted, the next drop of the ink may be jetted in an undesired direction. Alternatively, if the meniscus overshoots a proper range toward the nozzle so much, mist of the ink may be generated i.e. quality of printed images may be deteriorated.

Then, in order to prevent generation of the mist of the ink or the like by reducing (damping) the remaining vibration of the meniscus after the drop of the ink is jetted, the Japanese Laid-Open Publication No. 9-52360 has proposed an ink-jetting recording apparatus. The ink-jetting recording apparatus is adapted to generate a driving signal including: a first signal-element for causing a pressure chamber to expand, a second signal-element for causing the pressure chamber to contract from an expanded state thereof in order to jet a drop of the ink through a nozzle, and a third signal-element for causing the pressure chamber to expand by a volume smaller than a volume expanded by the first signal-element just when a vibration of the meniscus turns toward the nozzle after the drop of the ink is jetted. Thus, the meniscus, which is going to turn toward the nozzle after the drop of the ink is jetted, is pulled back toward the pressure chamber because the pressure chamber is caused to expand by the third signal-element. Thus, the vibration of the meniscus can be reduced effectively. Thus, the generation of the mist of the ink, which may be caused by movement of the meniscus, can be prevented. In addition, a position of the meniscus can be adjusted to a substantially regular position when a next drop of the ink is jetted, so that the next drop of the ink can be jetted more stably.

However, in the above recording apparatus, if a plurality of the drops of the ink are successively jetted at a high speed by using driving signals repeated with a short period, some pressure chambers which should not be deformed may be deformed (cross talk). Thus, meniscuses in the nozzles communicating with these pressure chambers may be caused to vibrate, although the meniscuses should not vibrate. Thus, if a meniscus in a nozzle corresponding to a pressure chamber which should not be deformed (a meniscus in a nozzle through which a drop of the ink should not be jetted) is caused to vibrate, when a drop of the ink is jetted through the nozzle in the future, the drop of the ink may be jetted unstably, for example the drop of the ink may be jetted in an undesired direction.

SUMMARY OF THE INVENTION

The object of this invention is to solve the above problems, that is, to provide a liquid jetting apparatus such as an ink-jet recording apparatus that can effectively reduce a vibration of a meniscus in a nozzle corresponding to a pressure chamber which should not be deformed in order to jet a drop of liquid more stably.

In order to achieve the object, a liquid jetting apparatus includes: a pressure chamber having an inside space whose volume is changeable, into which a liquid is supplied and which is communicated with a nozzle, a Helmholtz resonance frequency of said pressure chamber having a period of TH; a signal-generating unit that can generate a driving signal including a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted; and a pressure-generating unit that can cause the pressure chamber to expand and contract, based on the driving signal; wherein an interval between a starting time of outputting the first signal-element and a starting time of outputting the second signal-element is set substantially equal to the period TH of the Helmholtz resonance frequency; an interval between a starting time of outputting the second signal-element and a starting time of outputting the third signal-element is also set substantially equal to the period TH of the Helmholtz resonance frequency; and a sum of an amplitude of the first signal-element and an amplitude of the third signal-element is set substantially equal to an amplitude of the second signal-element.

According to the feature, the second signal-element is outputted in reverse (opposite) phase with a remaining vibration of the pressure chamber expanded by the first signal-element, and the third signal-element is outputted in reverse phase with a remaining vibration of the pressure chamber contracted by the second signal-element. In addition, a sum of the remaining vibrations of the pressure chamber expanded and contracted by the three signal-elements becomes substantially zero. That is, the first signal-element, the second signal-element and the third signal-element are outputted with respective largenesses at respective timings in such a manner that the remaining vibrations are drowned out by each other.

Thus, a deformation of a pressure chamber that should not be deformed and a vibration of a meniscus in a nozzle corresponding to the pressure chamber can be prevented effectively.

Alternatively, a liquid jetting apparatus includes: a pressure chamber having an inside space whose volume is changeable, into which a liquid is supplied and which is communicated with a nozzle, a Helmholtz resonance frequency of said pressure chamber having a period of TH; a signal-generating unit that can generate a driving signal including a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted; and a pressure-generating unit that can cause the pressure chamber to expand and contract, based on the driving signal; wherein an interval between a starting time of outputting the first signal-element and a starting time of outputting the second signal-element is set substantially equal to the period TH of the Helmholtz resonance frequency; an interval between a starting time of outputting the second signal-element and a starting time of outputting the third signal-element is also set substantially equal to the period TH of the Helmholtz resonance frequency; and durations of the first signal-element, the second signal-element and the third signal-element are set substantially equal to each other.

According to the feature, similarly, the second signal-element is outputted in reverse phase with a remaining vibration of the pressure chamber expanded by the first signal-element, and the third signal-element is outputted in reverse phase with a remaining vibration of the pressure chamber contracted by the second signal-element. In addition, a sum of the remaining vibrations of the pressure chamber expanded and contracted by the three signal-elements becomes substantially zero. That is, the first signal-element, the second signal-element and the third signal-element are outputted with respective largenesses at respective timings in such a manner that the remaining vibrations are drowned out by each other.

Thus, a deformation of a pressure chamber that should not be deformed and a vibration of a meniscus in a nozzle corresponding to the pressure chamber can be prevented effectively.

Each of the durations of the first signal-element, the second signal-element and the third signal-element can be controlled relatively easily.

Preferably, each of the durations of the first signal-element, the second signal-element and the third signal-element is set shorter than the period TH of the Helmholtz resonance frequency. In the case, the driving signal itself is shorter, so that a plurality of drops of the liquid can be jetted successively with a higher frequency.

Preferably, each of the durations of the first signal-element, the second signal-element and the third signal-element is set substantially equal to a natural period (characteristic period) TA of the pressure-generating unit. In the case, generation of remaining vibrations of the pressure-generating unit itself can be inhibited, so that the remaining vibrations of the pressure chamber can be restrained more effectively.

Preferably, the driving signal is successively generated according to a period which is substantially equal to a sum of a multiple of integer not less than three of the period TH of the Helmholtz resonance frequency and a half of the period TH of the Helmholtz resonance frequency. In the case, if the driving signal is successively generated in order to jet a plurality of drops of the liquid successively, a vibration by one driving signal and a vibration by the next driving signal may be drowned out by each other, so that the remaining vibrations can be restrained more effectively.

In order to achieve a shorter repeating period of the driving signal, the driving signal is preferably successively generated according to a period which is substantially equal to 3.5 times of the period TH of the Helmholtz resonance frequency.

In addition, preferably, the amplitude of the third signal-element is set 0.25 to 0.75 times as great as the amplitude of the second signal-element. In the case, after the drop of the liquid has been jetted, the vibration of the meniscus can be reduced (damped) by the third signal-element more effectively. Thus, generation of mist of the liquid can be prevented more effectively.

For example, the pressure-generating unit has a piezoelectric vibrating member. In order to jet a plurality of drops of the liquid successively at a high speed, it is preferable that the piezoelectric vibrating member is a longitudinal-mode piezoelectric vibrating member.

This invention is extremely effective if the period TH of the Helmholtz resonance frequency is in a range of 5 $\mu$s to 20 $\mu$s.

In addition, this invention is a controlling unit that can control a liquid jetting apparatus including a pressure chamber having an inside space whose volume is changeable, into which a liquid is supplied and which is communicated with a nozzle, a Helmholtz resonance frequency of said pressure chamber having a period of TH, and a pressure-generating unit that can cause the pressure chamber to expand and contract, based on a driving signal; comprising: a signal-generating unit that can generate a driving signal including a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted; wherein an interval between a starting time of outputting the first signal-element and a starting time of outputting the second signal-element is set substantially equal to the period TH of the Helmholtz resonance frequency; an interval between a starting time of outputting the second signal-element and a starting time of outputting the third signal-element is also set substantially equal to the period TH of the Helmholtz resonance frequency; and a sum of an amplitude of the first signal-element and an amplitude of the third signal-element is set substantially equal to an amplitude of the second signal-element.

Alternatively this invention is a controlling unit that can control a liquid jetting apparatus including a pressure chamber having an inside space whose volume is changeable, into which a liquid is supplied and which is communicated with a nozzle, a Helmholtz resonance frequency of said pressure chamber having a period of TH, and a pressure-generating unit that can cause the pressure chamber to expand and contract, based on a driving signal; comprising: a signal-generating unit that can generate a driving signal including a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted; wherein an interval between a starting time of outputting the first signal-element and a starting time of outputting the second signal-element is set substantially equal to the period TH of the Helmholtz resonance frequency; an interval between a starting time of outputting the second signal-element and a starting time of outputting the third signal-element is also set substantially equal to the period TH of the Helmholtz resonance frequency; and durations of the first signal-element, the second signal-element and the third signal-element are set substantially equal to each other.

A computer system can materialize the whole controlling unit or only one or more components in the controlling unit.

This invention includes a storage unit capable of being read by a computer, storing a program for materializing the controlling unit in a computer system.

This invention also includes the program itself for materializing the controlling unit in the computer system.

This invention includes a storage unit capable of being read by a computer, storing a program including a command for controlling a second program executed by a computer system including a computer, the program being executed by the computer system to control the second program to materialize the controlling unit.

This invention also includes the program itself including the command for controlling the second program executed by the computer system including the computer, the program being executed by the computer system to control the second program to materialize the controlling unit.

The storage unit may be not only a substantial object such as a floppy disk or the like, but also a network for transmitting various signals.

BEST MODE FOR CARRYING OUT THE INVENTION

Embodiments of the invention will now be described in more detail with reference to drawings.

Figure 1:
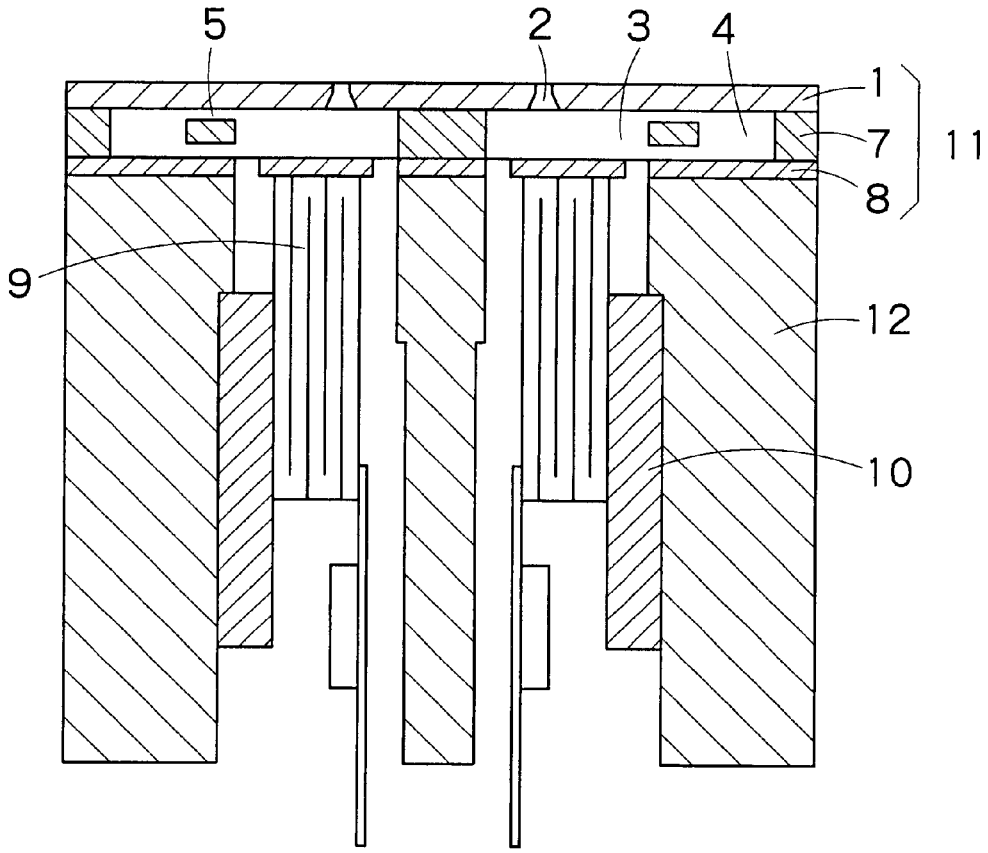
FIG. 1 is a sectional view of an example of recording head used in an ink-jetting recording apparatus of an embodiment according to the invention.

FIG. 1 shows an example of recording head used in an ink-jetting recording apparatus (a kind of liquid jetting apparatus) of an embodiment according to the invention. The recording head shown in FIG. 1 mainly consists of an ink-way unit 11 having nozzles 2 and pressure chambers 3 and a head-case 12 accommodating piezoelectric vibrating members 9. The ink-way unit 11 and the head-case 12 are joined to each other.

As shown in FIG. 1, the ink-way unit 11 is formed by stacked (layered) nozzle plate 1, way-forming plate 7 and elastic plate 8. The nozzles 2 are formed through the nozzle plate 1. The way-forming plate 7 includes a space corresponding to the pressure chambers 3, common ink reservoirs 4 and ink supplying ways 5 connecting the pressure chambers 3 and the common ink reservoirs 4. The elastic plate 8 defines at least a part of the pressure chambers 3.

The piezoelectric vibrating member 9 consists of a piezoelectric material and an electric conductive layer, which are alternatively stacked in parallel to a longitudinal direction thereof. Thus, the piezoelectric vibrating member 9 can contract in the longitudinal direction thereof when the piezoelectric vibrating member 9 is charged. In addition, the piezoelectric vibrating member 9 can return to an original state thereof (extend from a contracted state in the longitudinal direction) when the piezoelectric vibrating member 9 is discharged. That is, the piezoelectric vibrating member 9 is a longitudinal-mode piezoelectric vibrating member. A movable end of the piezoelectric vibrating member 9 is joined to a part of the elastic plate 8 that defines a part of a corresponding pressure chamber 3, and the other end is fixed to the head-case 12 via a base member 10.

In such a recording head, a pressure chamber 3 can expand and contract by causing a corresponding piezoelectric vibrating member 9 to contract and extend. Thus, a pressure of ink in the pressure chamber 3 can be changed so that the ink can be supplied into the pressure chamber 3 and a drop of the ink can be jetted through a corresponding nozzle 2.

In such an ink-jetting recording head as described above, a Helmholtz resonance frequency FH of the pressure chamber 3 can be represented by the following expression.

$$FH=1/(2\tau)\times\sqrt{\{(Mn+Ms)/[(Ci+Cv)\times(Mn\times Ms)]\}}$$

Herein, Ci means a fluid compliance affected by a compressive character of the ink in the pressure chamber 3. Cv means a solid compliance of the material itself of the elastic plate 8, the nozzle plate 1 or the like forming the pressure chamber 3. Mn means an inertance of the nozzle 2, and Ms means an inertance of the ink supplying way 5.

A period TH of the Helmholtz resonance frequency can be represented by a reciprocal of the Helmholtz resonance frequency FH (TH=1/FH).

When a volume of the pressure chamber 3 is represented by V, a density of the ink is represented by ρ and a speed of sound in the ink is represented by c, the fluid compliance Ci can be represented by the following expression.

$$Ci=V/(\rho\times c^2)$$

In addition, the solid compliance Cv of the pressure chamber 3 corresponds to a static deforming rate of the pressure chamber 3 when a unit of pressure is applied to the pressure chamber 3.

In detail, for example, when the pressure chamber 3 has a length of 0.5 mm to 2 mm, a width of 0.1 mm to 0.2 mm and a depth of 0.05 mm to 0.3 mm, the Helmholtz resonance frequency FH is in a range of 50 kHz to 200 kHz, that is, the period TH of the Helmholtz resonance frequency is in a range of 5 μsec to 20 μsec. In more detail, for example, when the solid compliance Cv is $7.5\times10^{-21}$ [$m^5$/N], the liquid compliance Ci is $5.5\times10^{-21}$ [$m^5$/N], the inertance Mn of the nozzle 2 is $1.5\times10^{8}$ [Kg/$m^4$] and the inertance Ms of the ink supplying way 5 is $3.5\times10^8$ [Kg/m$^4$], the Hermholtz resonance frequency FH is 136 kHz, that is, the period TH of the Hermholtz resonance frequency is 7.3 $\mu$sec.

Figure 2:
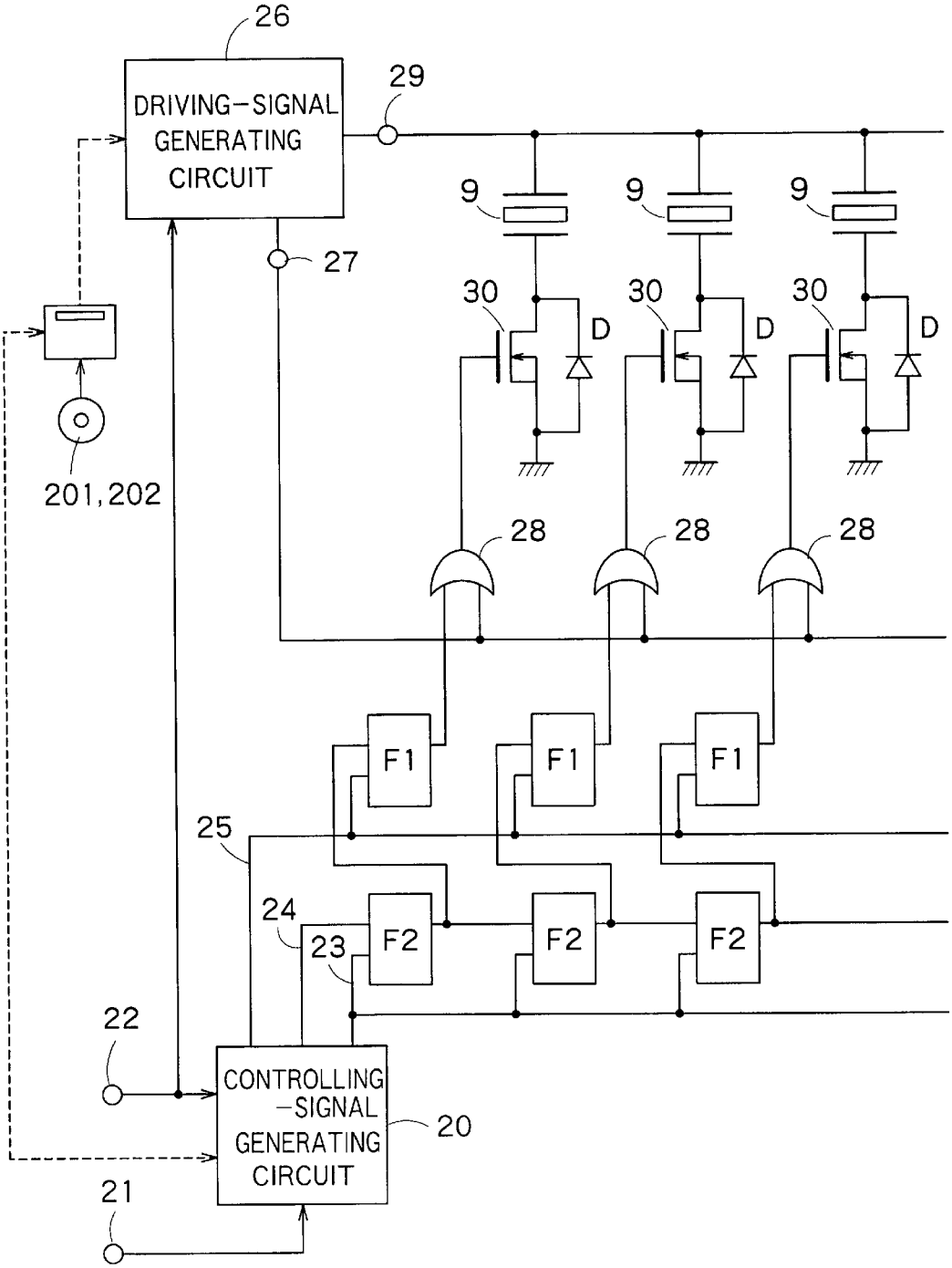
FIG. 2 is a block diagram of an example of driving circuit for the recording head shown in FIG. 1.

FIG. 2 shows an example of driving circuit for driving the above recording head. As shown in FIG. 2, a controlling-signal generating circuit 20 has input terminals 21 and 22 and output terminals 23, 24 and 25. A printing signal and a timing signal are adapted to be inputted to the input terminals 21 and 22, respectively, from an outside unit which can generate printing data. A shift-clock signal, a printing signal and a latch signal are adapted to be outputted from the output terminals 23, 24 and 25, respectively.

A driving-signal generating circuit 26 is adapted to output a driving signal for driving the piezoelectric vibrating members 9, based on the timing signal from the outside unit that is similar to the signal inputted to the input terminal 22.

F1 represents a flip-flop circuit functioning as a latch circuit. F2 represents a flip-flop circuit functioning as a shift register. If signals outputted from the flip-flop circuits F2 correspondingly to the respective piezoelectric vibrating members 9 are latched by the flip-flop circuits F1, selecting signals are outputted to respective switching transistors 30 via OR gates 28.

Figure 3:
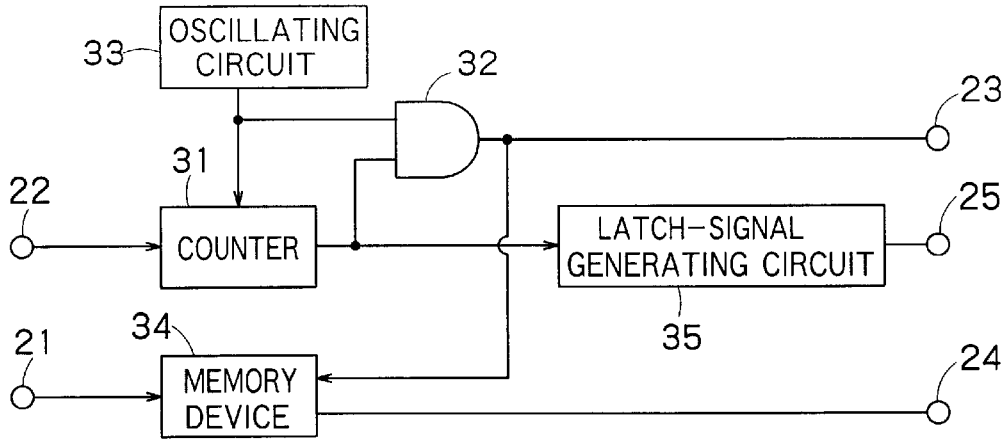
FIG. 3 is a block diagram of an example of the controlling-signal generating circuit shown in FIG. 2.

FIG. 3 shows an example of the controlling-signal generating circuit 20. A counter 31 is adapted to be initialized just when the timing signal inputted through the input terminal 22 rises up (see FIG. 5(I)). After the counter 31 is initialized, the counter 31 starts to count clock-signals from an oscillating circuit 33. When a counted value reaches a number of the piezoelectric vibrating members 9 connected to an output terminal 29 of the driving-signal generating circuit 26 (a number of the pressure chambers 3 capable of being deformed), the counter 31 is adapted to output a carry-signal being a Low level and stop counting. An AND gate 32 makes a logical product of the carry-signal from the counter 31 and the clock-signal from the oscillating circuit 33. The logical product is outputted to the output terminal 23 as the shift-clock signal.

A memory device 34 is adapted to store the printing data including the same number of bits as the piezoelectric vibrating members 9. The printing data is adapted to be inputted through the input terminal 21. The memory device 34 has a function to output the printing data stored therein in a serial manner i.e. bit by bit to the output terminal 24, synchronously with the signal from the AND gate 32.

Figure 5:
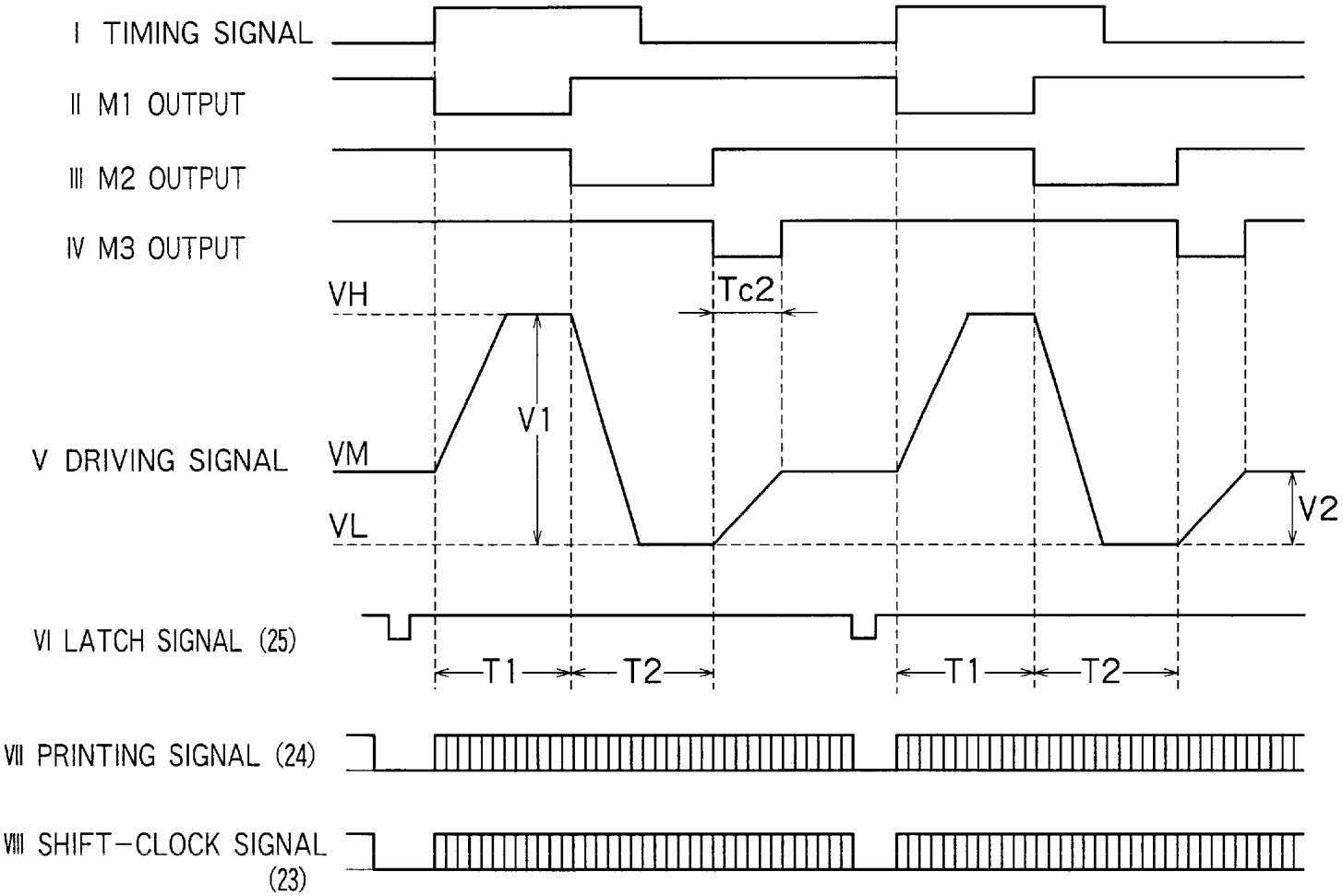
FIG. 5 is a schematic view for showing respective waveforms of respective signals.

The printing signal serially transmitted from the output terminal 24 (see FIG. 5(VII)) is latched by the flip-flop circuits F2 (shift registers) based on the shift-clock signal (see FIG. 5(VIII)) outputted from the output terminal 23, in order to become selecting signals for the switching transistors 30 for the next printing period. Latch signals are outputted from a latch-signal generating circuit 35, synchronously with the carry-signal being a Low level from the counter 31. The latch signals are outputted at a point of time when the driving signal maintains a medium voltage VM.

Figure 4:
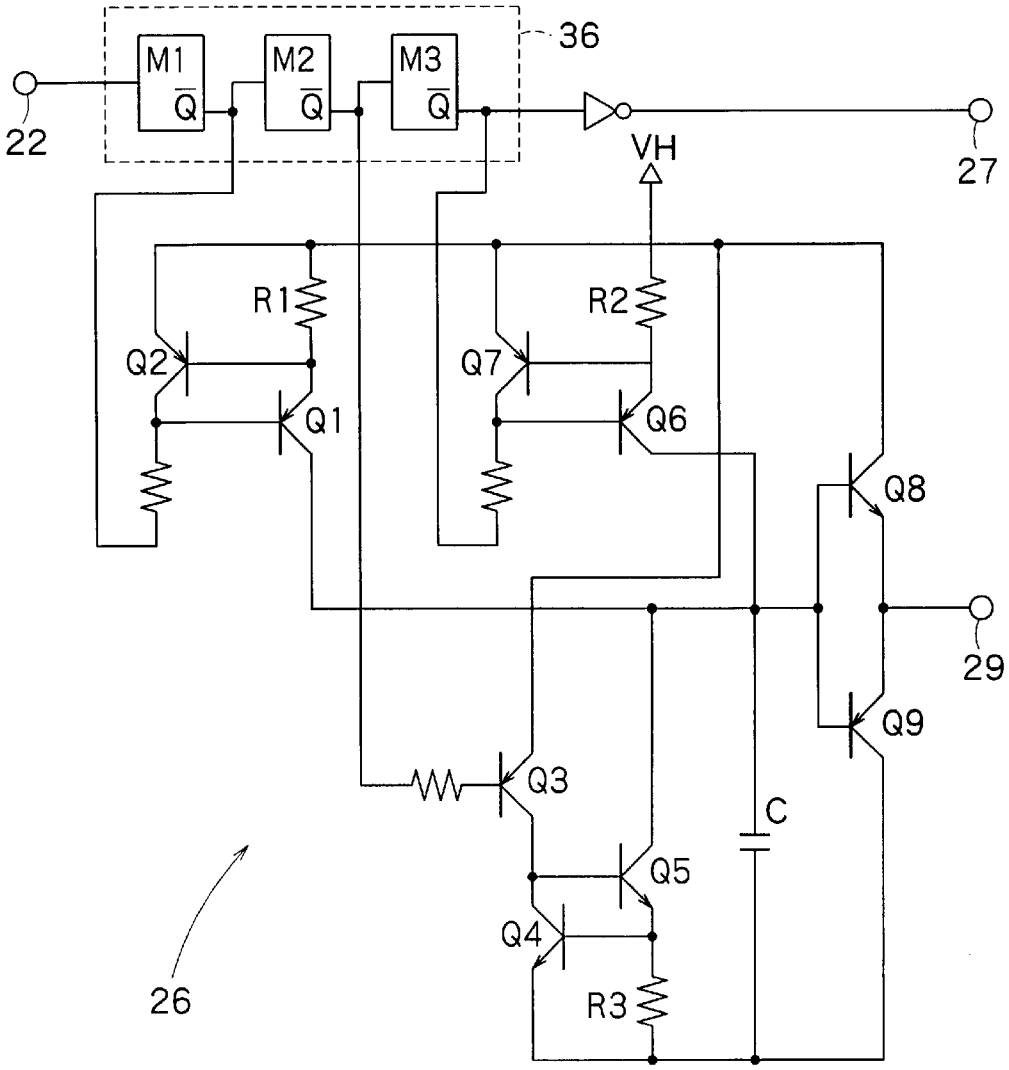
FIG. 4 is a circuit diagram of an example of the driving-signal generating circuit shown in FIG. 2.

FIG. 4 shows an example of the driving-signal generating circuit 26. A timing-controlling circuit 36 has three one-shot multi-vibrator circuits M1, M2 and M3, which are connected in a series. In each of the one-shot multi-vibrator circuits M1, M2 and M3, pulse-widths PW1, PW2 and PW3 (see FIG. 5(II)(III) and (IV)) are set for defining a sum (T1=Tc1+Th1; see FIG. 6) of 25 a first charging time (Tc1; see FIG. 6) and a first holding time (Th1; see FIG. 6), a sum (T2=Td+Th2; see FIG. 6) of a discharging time (Td; see FIG. 6) and a second holding time (Th2; see FIG. 6), and a second charging time (Tc2; see FIG. 6). Numerical signs 27 and 29 represent respective terminals.

As shown in FIG. 4, just when pulses outputted from the respective one-shot multi-vibrator circuits M1, M2 and M3 rise up or fall down, a transistor Q2 for conducting a charging operation, a transistor Q3 for conducting a discharging operation and a transistor Q6 for conducting a second charging operation are controlled ON or OFF. Additionally, transistors Q5, Q8, and Q9 are similar to transistor Q1, which is described in greater detail below.

Then, the driving-signal generating circuit 26 shown in FIG. 4 is explained in more detail.

If the timing signal is inputted from the outside unit to the input terminal 22, the first one-shot multi-vibrator M1 in the timing-controlling circuit 36 outputs a pulse signal (see FIG. 5(II)) having a pulse-width PW1 (Tc1+Th1), which has been set therein in advance. The transistor Q1 is turned ON by the pulse signal. Thus, a capacitor C that has been already charged to a medium voltage VM in an initial state is further charged by a constant electric current Ic1 determined by the transistor Q2 and a resister R1. When the capacitor C is charged to a power-source voltage VH (when a potential difference between capacitor's opposite terminals reaches the power-source voltage VH),the charging operation is automatically stopped. After that, the voltage of the capacitor C is maintained at the voltage VH until the discharging operation is conducted.

After a time corresponding to the pulse-width PW1 of the one-shot multi-vibrator M1 (Tc1+Th1=T1) has passed, the pulse signal falls down (see FIG. 5(II)). Then, the transistor Q1 is turned OFF. On the other hand, a pulse signal (see FIG. 5(III)) having a pulse-width PW2 (Td+Th2) is outputted from the second one-shot multi-vibrator M2. The transistor Q3 is turned ON by the pulse signal. Thus, the capacitor C is continuously discharged to substantially a voltage VL, by a constant electric current Id determined by a transistor Q4 and a resister R3.

After a time corresponding to the pulse-width PW2 of the one-shot multi-vibrator M2 (Td+Th2=T2) has passed, the pulse signal falls down (see FIG. 5(III)). Then, the transistor Q2 is turned OFF. On the other hand, a pulse signal (see FIG. 5(W)) having a pulse-width PW3 is outputted from the third one-shot multi-vibrator M3. The transistor Q6 is turned ON by the pulse signal. Thus, the capacitor C is charged again by a constant electric current Ic2 to the medium voltage VM determined by the time (Tc2) corresponding to the pulse-width PW3 of the third one-shot multi-vibrator M3. When the capacitor C is charged again to the voltage VM, the charging operation is automatically stopped.

By the above charging and discharging operations, as shown in FIG. 5, a driving signal (see FIG. 5(V)) is generated in such a manner that the driving signal rises up from the medium voltage VM to the voltage VH at a constant inclination, holds the voltage VH for a certain time Th1, falls down to the voltage VL at a constant inclination, holds the voltage VL for a certain time Th2, and rises up again to the medium voltage VM.

Herein, in the driving-signal generating circuit 26 shown in FIG. 4, the charging electric current Ic1, the discharging electric current Id, the charging electric current Tc2, the charging time Tc1, the discharging time Td and the charging time Tc2 can be represented by the following expressions respectively, by using a capacitance CO of the capacitor C, a resistance Rr1 of the resister R1, a resistance Rr2 of the resister R2, a resistance Rr3 of the resister R3, a base-emitter voltage Vbe2 of the transistor Q2, a base-emitter voltage Vbe4 of the transistor Q4 and a base-emitter voltage Vbe7 of the transistor Q7.

$$Ic1=Vbe2/Rr1$$

$$Id=Vbe4/Rr3$$

$$Ic2=Vbe7/IRr2$$

$$Tc1=C0\times(VH-VM)/Ic1$$

$$Td=C0\times(VH-VL)/Id$$

$$Tc2=C0\times(VM-VL)/Ic2$$

As described above, if the longitudinal-mode piezoelectric vibrating members 9 are used as actuators for causing the pressure chambers 3 to expand and contract, and a plurality of drops of the ink are successively jetted according to driving signals repeated with a short period (interval: fmax in FIG. 6B), some pressure chambers 3 that should not be deformed may be deformed (cross talk). Thus, meniscuses in the corresponding nozzles may be caused to vibrate, although the meniscuses should not vibrate. Thus, when a drop of the ink is jetted through the nozzle in the future (for example, based on the next driving period), the drop of the ink may be jetted unstably.

Figure 6A:
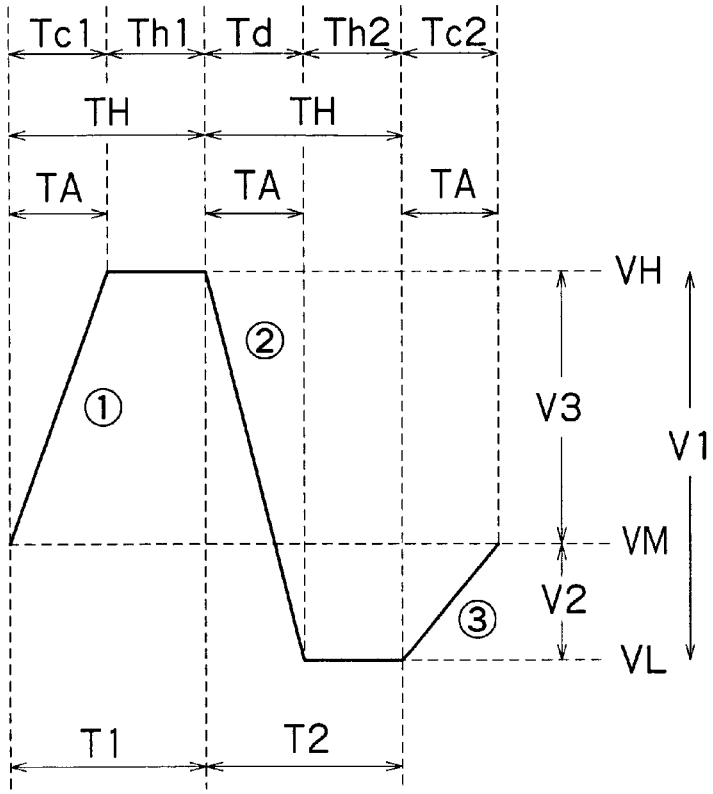
FIGS. 6A and 6B are schematic views for explaining respective parameters for defining a driving signal.
Figure 7:
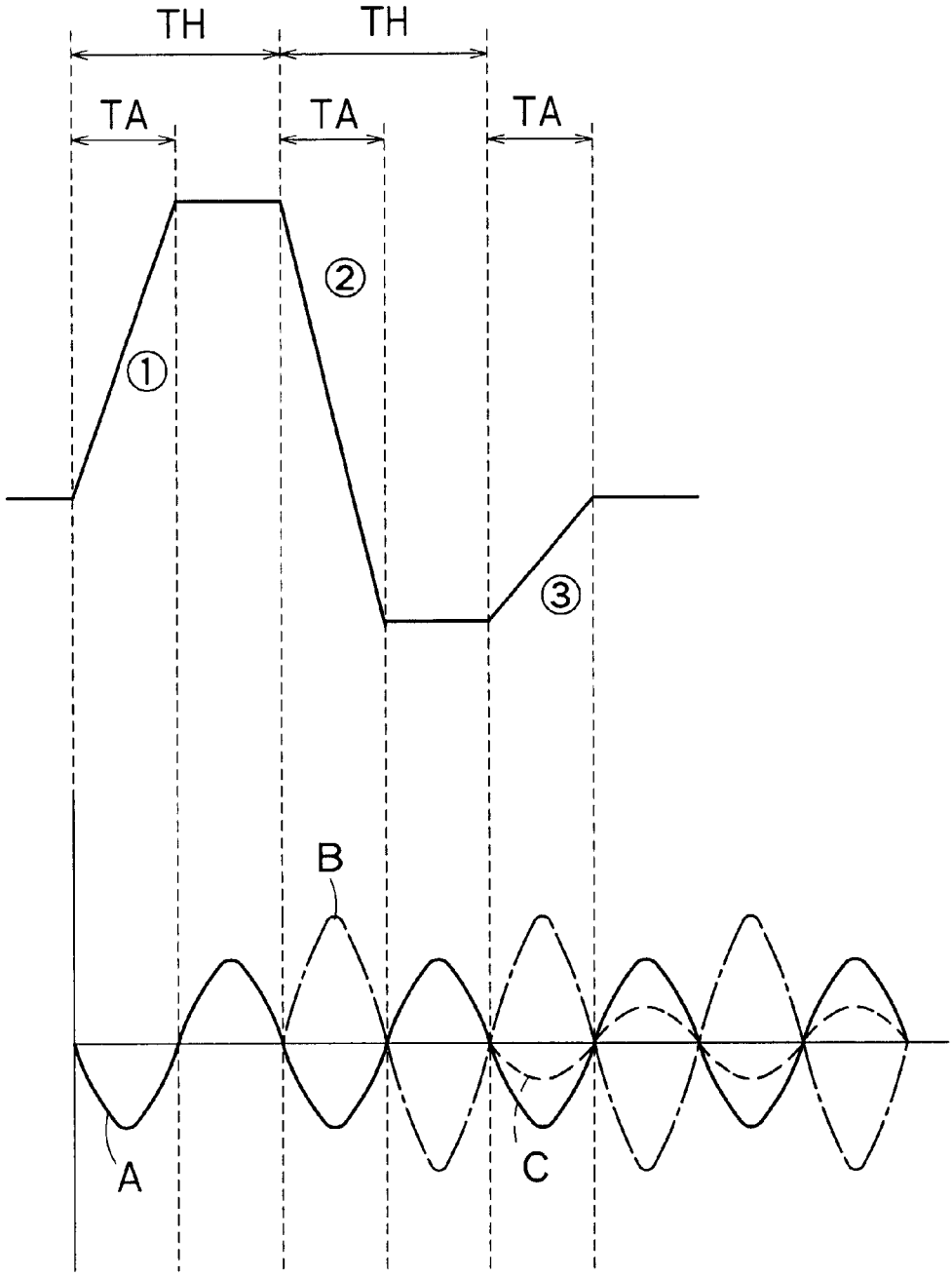
FIG. 7 is a schematic view for explaining a state wherein remaining vibrations by three signal-elements are drowned out by each other.

Thus, in the above ink-jetting recording apparatus, as shown in FIG. 6A, an interval between a starting time of outputting the first charging signal-element ① (first signal-element) and a starting time of outputting the discharging signal-element ② (second signal-element), that is, the sum (T1=Tc1+Th1) of the first charging time (Tc1) and the first holding time (Th1) is set substantially equal to the period TH of the Helmholtz resonance frequency. In addition, an interval between a starting time of outputting the discharging signal-element ② (second signal-element) and a starting time of outputting the second charging signal-element if (third signal-element), that is, the sum (T2=Td+Th2) of the discharging time (Td) and the second holding time (Th2) is also set substantially equal to the period TH of the Helmholtz resonance frequency. Thus, as shown in FIG. 7, the discharging signal-element ② is outputted in reverse phase with a remaining vibration A of expanding movement by the first charging signal-element ①, and the second charging signal-element ③ is outputted in reverse phase with a remaining vibration B of contracting movement by the discharging signal-element ②.

In addition, in the above ink-jetting recording apparatus, a sum of an amplitude of the first charging signal-element ① and an amplitude of the second charging signal-element ③ is set substantially equal to an amplitude of the discharging signal-element ②. In the case, a duration (Tc1) of the first charging signal-element ①, a duration (Td) of the discharging signal-element ② and a duration (Tc2) of the second charging signal-element ③ are set substantially equal to each other. Thus, as shown in FIG. 7, a sum of the amplitudes of the remaining vibrations A, B and C of the pressure chamber 3 expanded and contracted by the three signal-elements (①, ② and ③ becomes substantially zero.

According to the above structure, in the above ink-jetting recording apparatus, the first charging signal-element (①, the discharging signal-element ② and the second charging signal-element ③ are outputted with respective largenesses at respective timings in such a manner that the remaining vibrations are drowned out by each other. Thus, a deformation of the pressure chamber 3 that should not be deformed and a vibration of a meniscus in a nozzle corresponding to the pressure chamber 3 can be prevented effectively. Thus, it can be prevented that a drop of the ink is jetted unstably in the future through the nozzle, through which a drop of the ink should not be jetted at that time.

In addition, in the above ink-jetting recording apparatus, the duration (Tc1) of the first charging signal-element ①, the duration (Td) of the discharging signal-element ② and the duration (Tc2) of the second charging signal-element ③ are set substantially equal to a natural period (characteristic period) TA of the piezoelectric vibrating member 9. Thus, remaining vibrations of the piezoelectric vibrating members 9 can be restrained more effectively. Thus, the remaining vibrations themselves of the pressure chambers 3 can be restrained effectively, so that it can be more effectively prevented that a drop of the ink is jetted unstably.

Figure 6B:
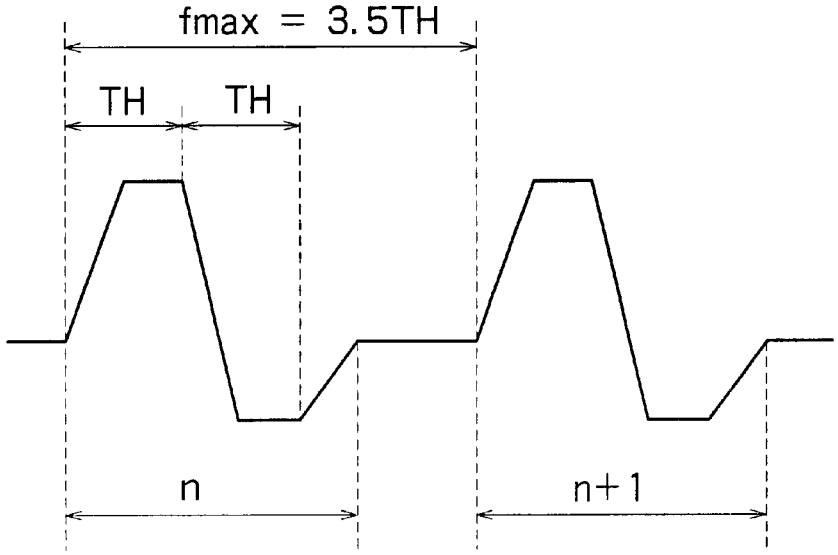

In addition, in the above ink-jetting recording apparatus, as shown in FIG. 6B, the driving signal is preferably successively generated according to a period (fmax) which is substantially equal to 3.5 times of the period TH of the Helmholtz resonance frequency. In the case, if the driving signal is successively generated in order to jet a plurality of drops of the ink successively, a vibration by one driving signal (n) and a vibration by the next driving signal (n+1) may be drowned out by each other, so that the remaining vibrations can be restrained more effectively. In addition, an interval between successive two driving signals can be short enough to drive the piezoelectric vibrating members 9 with a higher frequency.

The period fmax, with which the driving signal is repeated, is not limited by 3.5 times of the period TH of the Helmholtz resonance frequency, but could be set substantially equal to a sum of a multiple of integer not less than three of the period TH of the Helmholtz resonance frequency and a half of the period TH of the Helmholtz resonance frequency. In a theory of the invention, the period fmax may be 2.5 times of the period TH of the Helmholtz resonance frequency. However, in practice, a time for changing wave-signals or the like is necessary between the successive two driving signals. Thus, it is unsuitable that the period fmax is set 2.5 times of the period TH of the Helmholtz resonance frequency.

In addition, in the above ink-jetting recording apparatus, it is preferable that a potential difference V2 (amplitude) of the second charging signal-element ③ is set 0.25 to 0.75 times as great as a potential difference V1 (amplitude) of the discharging signal-element ②. In the case, after the drop of the ink has been jetted by the discharging signal-element ②, the vibration of the meniscus can be suitably reduced by the second charging signal-element ③. Thus, generation of mist of the ink can be prevented, so that a drop of the ink can be jetted more stably.

Figure 8:
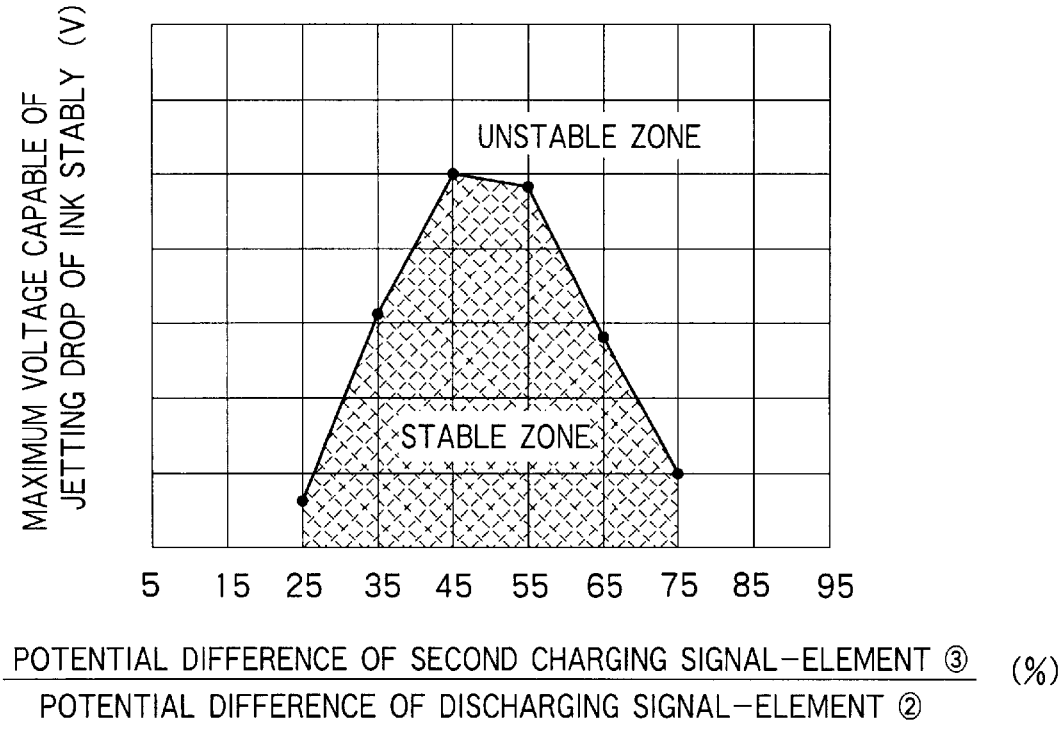
FIG. 8 is a graph for showing a relationship between a ratio of a voltage difference of a second charging signal-element to a voltage difference of a discharging signal-element and a maximum voltage capable of jetting a drop of the ink stably.

Then, a relationship between a ratio of the potential difference of the second charging signal-element ③ to the potential difference of the discharging signal-element ② and a maximum voltage capable of jetting a drop of the ink stably is explained with reference to FIG. 8. If the potential difference V2 of the second charging signal-element ③ is less than 0.25 times as great as the potential difference V1 of the discharging signal-element ②, it is difficult for the vibration of the meniscus to be sufficiently reduced by the second charging signal-element ③, after the drop of the ink has been jetted by the discharging signal-element ②. That is, a next drop of the ink cannot be jetted stably. On the other hand, if the potential difference V2 of the second charging signal-element ③ is more than 0.75 times as great as the potential difference V1 of the discharging signal-element ②, the meniscus may be caused to vibrate more by the second charging signal-element ③, after the drop of the ink has been jetted by the discharging signal-element ②. That is, a next drop of the ink cannot be jetted stably.

Herein, it is preferable that the maximum voltage capable of jetting a drop of the ink stably is higher because a suitable voltage is selected from a larger zone.

Then, an operation of the embodiment is explained. As described above, the controlling-signal generating circuit 20 transmits the selecting signals for the switching transistors 30 to the flip-flop circuits F1 during a prior printing period. The selecting signals are latched by the flip-flop circuits F1 while all of the piezoelectric vibrating members 9 are charged to the medium voltage VM. Then, when the timing signal is inputted, the driving signal (FIG. 5(V)) rises up from the medium voltage VM to the voltage VH (the first charging signal-element ①. Thus, selected piezoelectric vibrating members 9 are charged to contract at a substantially constant speed, so that the corresponding pressure chambers 3 are caused to expand.

When the pressure chambers 3 expand, the ink in the corresponding common ink reservoirs 4 flow into the pressure chambers 3 through the corresponding ink supplying ways 5. At the same time, the meniscuses in the corresponding nozzles 2 are pulled toward the respective pressure chambers 3. When the driving signal reaches the voltage VH, the voltage VH is maintained for the predetermined time Th1. Then, the driving signal falls down to the voltage VL (the discharging signal-element ②. At that time, the discharging signal-element ② is outputted in reverse phase with the remaining vibrations A of the pressure chambers 3 caused to expand by the first charging signal-element ①.

When the driving signal falls down to the voltage VL, electric charges of the piezoelectric vibrating members 9, which is charged to the voltage VH, are discharged via respective diodes D. Thus, the piezoelectric vibrating members 9 extend, so that the corresponding pressure chambers 3 are caused to contract. Then, the ink in the pressure chambers 3 is pressed, and drops of the ink are jetted from the corresponding nozzles 2, respectively.

In addition, just when the vibrating meniscuses are pulled toward the pressure chambers 3 most and are going to turn (go back) toward the nozzles 2, the driving signal rises up again from the voltage VL to the medium voltage VM (the second charging signal-element ③. Thus, the piezoelectric vibrating members 9 are charged again in order to minutely extend. At that time, the second charging signal-element ③ is outputted in reverse phase with the remaining vibrations B of the pressure chambers 3 caused to contract by the discharging signal-element ②. When the pressure chambers 3 expand minutely, the meniscuses, which are going to start moving toward the nozzles 2, are pulled back toward the respective pressure chambers 3. Thus, kinetic energy of the meniscuses may be reduced so much that the vibrations of the meniscuses may be damped rapidly. In addition, the sum of the remaining vibrations A, B and C of the pressure chambers 3 by the above three signal-elements ①, ② and ③ becomes substantially zero.

As described above, according to the above embodiment, the first charging signal-element ①, the discharging signal-element ② and the second charging signal-element ③ are outputted with the respective largenesses at the respective timings in such a manner that the remaining vibrations are drowned out by each other. Thus, a deformation of the pressure chamber 3 that should not be deformed and a vibration of a meniscus in a nozzle corresponding to the pressure chamber 3 can be prevented effectively. Thus, it can be prevented that a drop of the ink is jetted unstably.

In addition, the controlling-signal generating circuit 20, the driving-signal generating circuit 26 or the like can be materialized by a computer system. A program for materializing the above one or more components in a computer system, and a storage unit 201 storing the program and capable of being read by a computer, are intended to be protected by this application.

In addition, when the above one or more components may be materialized in a computer system by using a general program such as an OS, a program including a command or commands for controlling the general program, and a storage unit 202 storing the program and capable of being read by a computer, are intended to be protected by this application.

Each of the storage units 201 and 202 can be not only a substantial object such as a floppy disk or the like, but also a network for transmitting various signals.

The above description is given for the ink-jetting recording apparatus as a liquid jetting apparatus of an embodiment according to the invention. However, this invention is intended to apply to general liquid jetting apparatuses widely. A liquid may be glue, nail polish or the like, instead of the ink.

As described above, according to the invention, the second signal-element is outputted in reverse phase with the remaining vibration of the pressure chamber expanded by the first signal-element, and the third signal-element is outputted in reverse phase with the remaining vibration of the pressure chamber contracted by the second signal-element. In addition, the sum of the remaining vibrations of the pressure chamber expanded and contracted by the three signal-elements becomes substantially zero. That is, the first signal-element, the second signal-element and the third signal-element are outputted with the respective largenesses at the respective timings in such a manner that the remaining vibrations are drowned out by each other. Thus, a deformation of a pressure chamber that should not be deformed and a vibration of a meniscus in a nozzle corresponding to the pressure chamber can be prevented effectively.

Thus, it can be prevented that a drop of the ink is jetted unstably in the future through the nozzle through which a drop of the ink should not be jetted at that time.

What is claimed is:

1. A liquid jetting apparatus comprising a pressure chamber having an inside space whose volume is changeable, into which a liquid is supplied and which is communicated with a nozzle, a Helmholtz resonance frequency of said pressure chamber having a period of TH, a signal-generating unit that can generate a driving signal including: a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, and a pressure-generating unit that can cause the pressure chamber to expand and contract, based on the driving signal, wherein an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and a sum of an amplitude of the first signal-element and an amplitude of the third signal-element is set substantially equal to an amplitude of the second signal-element.

2. A liquid jetting apparatus according to claim 1, wherein:

the driving signal is successively generated according to a period which is substantially equal to a sum of a multiple of integer not less than three of the period TH of the Helmholtz resonance frequency and a half of the period TH of the Helmholtz resonance frequency.

3. A liquid jetting apparatus according to claim 2, wherein:

the driving signal is successively generated according to a period which is substantially equal to 3.5 times of the period TH of the Helmholtz resonance frequency.

4. A liquid jetting apparatus according to claim 1, wherein:

the amplitude of the third signal-element is set 0.25 to 0.75 times as great as the amplitude of the second signal-element.

5. A liquid jetting apparatus according to claim 1, wherein:

the pressure-generating unit has a piezoelectric vibrating member.

6. A liquid jetting apparatus according to claim 5, wherein:

the piezoelectric vibrating member is a longitudinal-mode piezoelectric vibrating member.

7. A liquid jetting apparatus according to claim 1, wherein:

the period TH of the Helmholtz resonance frequency is in a range of 5 $\mu$s to 20 $\mu$s.

8. A liquid jetting apparatus comprising a pressure chamber having an inside space whose volume is changeable, into which a liquid is supplied and which is communicated with a nozzle, a Helmholtz resonance frequency of said pressure chamber having a period of TH, a signal-generating unit that can generate a driving signal including: a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, and a pressure-generating unit that can cause the pressure chamber to expand and contract, based on the driving signal, wherein an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and durations of the first signal-element, the second signal-element and the third signal-element are set substantially equal to each other.

9. A liquid jetting apparatus according to claim 8, wherein:

each of the durations of the first signal-element, the second signal-element and the third signal-element is set shorter than the period TH of the Helmholtz resonance frequency.

10. A liquid jetting apparatus according to claim 9, wherein:

each of the durations of the first signal-element, the second signal-element and the third signal-element is set substantially equal to a natural period TA of the pressure-generating unit.

11. A liquid jetting apparatus according to claim 8, wherein:

the driving signal is successively generated according to a period which is substantially equal to a sum of a multiple of integer not less than three of the period TH of the Helmholtz resonance frequency and a half of the period TH of the Helmholtz resonance frequency.

12. A liquid jetting apparatus according to claim 11, wherein:

the driving signal is successively generated according to a period which is substantially equal to 3.5 times of the period TH of the Helmholtz resonance frequency.

13. A liquid jetting apparatus according to claim 8, wherein:

the pressure-generating unit has a piezoelectric vibrating member.

14. A liquid jetting apparatus according to claim 13, wherein:

the piezoelectric vibrating member is a longitudinal-mode piezoelectric vibrating member.

15. A liquid jetting apparatus according to claim 8, wherein:

the period TH of the Helmholtz resonance frequency is in a range of 5 $\mu$s to 20 $\mu$s.

16. A controlling unit that can control a liquid jetting apparatus including: a pressure chamber having an inside space whose volume is changeable, into which a liquid is supplied and which is communicated with a nozzle, a Helmholtz resonance frequency of said pressure chamber having a period of TH; and a pressure-generating unit that can cause the pressure chamber to expand and contract, based on a driving signal; comprising a signal-generating unit that can generate a driving signal including: a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, wherein an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and a sum of an amplitude of the first signal-element and an amplitude of the third signal-element is set substantially equal to an amplitude of the second signal-element.

17. A controlling unit according to claim 16, wherein:

the driving signal is successively generated according to a period which is substantially equal to a sum of a multiple of integer not less than three of the period TH of the Helmholtz resonance frequency and a half of the period TH of the Helmholtz resonance frequency.

18. A controlling unit according to claim 17, wherein:

the driving signal is successively generated according to a period which is substantially equal to 3.5 times of the period TH of the Helmholtz resonance frequency.

19. A controlling unit according to claim 16, wherein:

the amplitude of the third signal-element is set 0.25 to 0.75 times as great as the amplitude of the second signal-element.

20. A controlling unit that can control a liquid jetting apparatus including: a pressure chamber having an inside space whose volume is changeable, into which a liquid is supplied and which is communicated with a nozzle, a Helmholtz resonance frequency of said pressure chamber having a period of TH; and a pressure-generating unit that can cause the pressure chamber to expand and contract, based on a driving signal; comprising a signal-generating unit that can generate a driving signal including: a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, wherein an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and durations of the first signal-element, the second signal-element and the third signal-element are set substantially equal to each other.

21. A controlling unit according to claim 20, wherein:

each of the durations of the first signal-element, the second signal-element and the third signal-element is set shorter than the period TH of the Helmholtz resonance frequency.

22. A controlling unit according to claim 21, wherein:

each of the durations of the first signal-element, the second signal-element and the third signal-element is set substantially equal to a natural period TA of the pressure-generating unit.

23. A controlling unit according to claim 20, wherein:

the driving signal is successively generated according to a period which is substantially equal to a sum of a multiple of integer not less than three of the period TH of the Helmholtz resonance frequency and a half of the period TH of the Helmholtz resonance frequency.

24. A controlling unit according to claim 23, wherein:

the driving signal is successively generated according to a period which is substantially equal to 3.5 times of the period TH of the Helmholtz resonance frequency.

25. A storage unit capable of being read by a computer, storing a program for managing a controlling unit that can control a liquid jetting apparatus including; a pressure chamber having an inside space whose volume is changeable, into which a liquid is supplied and which is communicated with a nozzle, a Helmholtz resonance frequency of said pressure chamber having a period of TH; and a pressure-generating unit that can cause the pressure chamber to expand and contract, based on a driving signal;

wherein the controlling unit comprises a signal-generating unit that can generate a driving signal including: a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and a sum of an amplitude of the first signal-element and an amplitude of the third signal-element is set substantially equal to an amplitude of the second signal-element.

26. A storage unit capable of being read by a computer, storing a program for managing a controlling unit that can control a liquid jetting apparatus including; a pressure chamber having an inside space whose volume is changeable, into which a liquid is supplied and which is communicated with a nozzle, a Helmholtz resonance frequency of said pressure chamber having a period of TH; and a pressure-generating unit that can cause the pressure chamber to expand and contract, based on a driving signal;

wherein the controlling unit comprises a signal-generating unit that can generate a driving signal including: a first signal—element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and durations of the first signal-element, the second signal-element and the third signal-element are set substantially equal to each other.

27. A storage unit capable of being read by a computer, storing a program including a command for controlling a second program executed by a computer system including a computer, the program being executed by the computer system to control the second program to manage a controlling unit that can control a liquid jetting apparatus including:

a pressure chamber having an inside space whose volume is changeable, into which a liquid is supplied and which is communicated with a nozzle, a Helmholtz resonance frequency of said pressure chamber having a period of TH; and a pressure-generating unit that can cause the pressure chamber to expand and contract, based on a driving signal;

wherein the controlling unit comprises a signal-generating unit that can generate a driving signal including: a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and a sum of an amplitude of the first signal-element and an amplitude of the third signal-element is set substantially equal to an amplitude of the second signal-element.

28. A storage unit capable of being read by a computer, storing a program including a command for controlling a second program executed by a computer system including a computer, the program being executed by the computer system to control the second program to manage a controlling unit that can control a liquid jetting apparatus including: a pressure chamber having an inside space whose volume is changeable, into which a liquid is supplied and which is communicated with a nozzle, a Helmholtz resonance frequency of said pressure chamber having a period of TH; and a pressure-generating unit that can cause the pressure chamber to expand and contract, based on a driving signal;

wherein the controlling unit comprises a signal-generating unit that can generate a driving signal including: a first signal-element for causing the pressure chamber to expand, a second signal-element for causing the pressure chamber to contract from an expanded state thereof in order to jet a drop of the liquid through the nozzle, and a third signal-element for causing the pressure chamber to expand to an original state before outputting the first signal-element after the drop of the liquid is jetted, an interval between a starting time of outputting the first signal-element and a starting time of outputting the second signal-element is set substantially equal to the period TH of the Helmholtz resonance frequency, an interval between a starting time of outputting the second signal-element and a starting time of outputting the third signal-element is also set substantially equal to the period TH of the Helmholtz resonance frequency, and durations of the first signal-element, the second signal-element and the third signal-element are set substantially equal to each other.

* * * * *